United States Patent [19]

Chen

[11] Patent Number: 4,863,173

[45] Date of Patent: Sep. 5, 1989

[54] COMPUTERIZED BINGO-CHAIN GAME

[76] Inventor: Ying-Shiun Chen, P.O. Box 10780, Taipei, Taiwan

[21] Appl. No.: 883,786

[22] Filed: Jul. 9, 1986

[51] Int. Cl.[4] ..... A63F 3/06

[52] U.S. Cl. ..... 273/237; 273/269

[58] Field of Search ..... 273/237, 238, 239, 269, 273/138 A; 364/410–412, 401

[56] References Cited

U.S. PATENT DOCUMENTS

| | | | |
|---|---|---|---|
| 4,415,065 | 11/1983 | Sandstedt | 364/401 |
| 4,455,025 | 6/1984 | Itkis | 273/237 |
| 4,624,462 | 11/1986 | Itkis | 273/269 |
| 4,732,392 | 3/1988 | Kerr et al. | 273/237 |

*Primary Examiner*—Maryann Lastova

*Attorney, Agent, or Firm*—Pollock, Vande Sande & Priddy

[57] ABSTRACT

All of the number matrices of every bingo card (of the available cards) of a bingo-chain game device are stored in a microprocessor/storage unit. A display dot matrix is connected to the microprocessor/storage unit to identify the numbers selected by a player. A keyboard is connected to the microprocessor/storage unit so that the player can input every called number into the storage of the microprocessor/storage unit. A plurality of transparent bingo cards, with preset codes along one side thereof, is automatically read by a signal reading unit which also retrieves pre-stored data from the storage of the microprocessor/storage unit. The data on the transparent cards are stored into the storage of the microprocessor/storage unit. The signals on the transparent bingo cards can also be represented by bar codes. Data code and clock code on a single side of a transparent bingo card are read by the signal reading unit and can be pre-stored in the microprocessor/storage unit.

2 Claims, 10 Drawing Sheets

COMPUTERIZED BINGO-CHAIN GAME

BACKGROUND OF THE INVENTION

Bingo is a popular game, both in U.S.A. and Canada. Traditionally, bingo games are used by churches to raise funds for charity. Almost without any chance to cheat, bingo is fair to all players; accordingly, some state governments have explicitly legalized this game. Players of a traditional bingo game would keep a card with a pre-printed number matrix and would mark the pre-printed numbers of the matrix in accordance with the called numbers. Players, using their eyes and memory, would mark the pre-printed numbers in selected pattern tracks. To scan and mark a plurality of card is very hard and troublesome for the weak and the old players of a traditional bingo game.

In order to assist the players to rapidly scan and mark repeatedly the called numbers in a plurality of cards, many machines which can simulate bingo have been developed. U.S. patents which intend to automate bingo games include: U.S. Pat. Nos. 2,333,002; 2,760,619; 3,671,041; 4,080,596; 4,365,810; 4,378,940, etc. But the machines of these references fail to provide players with the appropriate assistance.

SUMMARY OF THE INVENTION

The present invention is a bingo-chain game device played with the bingo cards. Every transparent bingo card has a set of 24 numbers ranging from 1 to 75, and constituting a 5×5 number matrix with a blank space in the center thereof. Before the beginning of the game, the bingo cards are placed into a signal reading device so that the bingo card stands in front of a display. When one number of the bingo card is called, the LED behind the number will light. When every called number is manually inputted, the LEDs at the back of the numbers, which are equal to the called numbers and located in a plurality of bingo cards, will light simultaneously so as to assist the players. The means of the present invention include: (1) A Z-80A CPU based microprocessor/storage means to store/retrieve the called numbers and the number matrixes of the bingo cards; (2) A display, constituted by a LED dot matrix, to be interconnected with the microprocessor/storage means; (3) A keyboard input means, constituted by MYLAR film, to be interconnected to the microprocessor/storage means; (4) A transparent bingo card incorporating punch code or data and clock code represented by bar code in a single side of the said bingo card, wherein the punch code or data and clock code can be read through a signal reading means; (5) A double check sum means which can check the possible reading error of the data code and clock code in the bingo cards; (6) A signal reading means, constituted by infrared LEDs and photo-coupled receivers, to be interconnected to the microprocessor/storage means; (7) An erase means which can erase the called numbers from the microprocessor/storage means when the game is over.

The device of the present invention further incorporates an interconnection means which is composed of programmable I/O interface ICs and related software; therefore, every one of the present invention device can interconnect a plurality of the same devices from both of its sides. Each present invention device is able to transmit signals bi-directionally. Therefore, each device can be assigned as the master machine to receive signal and transmit the signal to other slave machines simultaneously. Thus constructed, the present invention has no need for the special communication IC 8251 and its peripheral circuit. Furthermore, the present invention is free of the defects of uni-directional communication of prior art.

Each highly precise signal reading means of the present invention includes at least an infrared LED and a photo-coupled receiver mainly constituted by a DARLINTON's pair where the infrared LED and the photo-coupled receiver are respectively set in the upper frame and lower frame, which are joined together with a V-type rail. Besides the benefit of easy assembly and high precision, the signal reading means also has good resolution and sensitivity.

The signal reading means of the present invention are interconnected in parallel and controlled by software. Therefore, if one of the signal reading means is damaged, the normal operation of the other signal reading means will not be affected.

The bingo card of the present invention incorporates punch code in a single side of the bingo card, wherein the length of the punch code can represent a binary 0 or 1 machine code. The signal representative of the punch code provides for the retrieval of data which is pre-stored in the ROM of the microprocessor/storage means and the data is then stored into the RAM of the microprocessor/storage means.

Another embodiment of the bingo cards of the present invention incorporates clock code and data code, represented by bar codes, on a single side of the bingo card. A wider bar code in the beginning of the clock code is assigned as the start code. A bingo card of the present invention only needs one set of single reading means to operate. Furthermore, it can solve the asynchronous problems of clock code and data code resulted from traditional double-sided check. A check means is also included in the present invention; therefore, the signal being read can be verified by the double check sum. The clock signal is related to the data signal through a function equation. After the data code and clock code are read, the data code and clock code can be verified by means of the function equation. The checking result can be shown in the LED display.

The present invention further provides a means to adjust the brightness of the LED display through a photo-sensitive resistor and a variable resistor. The present invention also provides a music generator means which is composed of a melody IC and an audio generating software program, wherein the volume of the music generator means can be adjusted through a variable resistor.

DETAILED DESCRIPTION OF THE PREFERRED EMBODIMENTS

Figure 1:
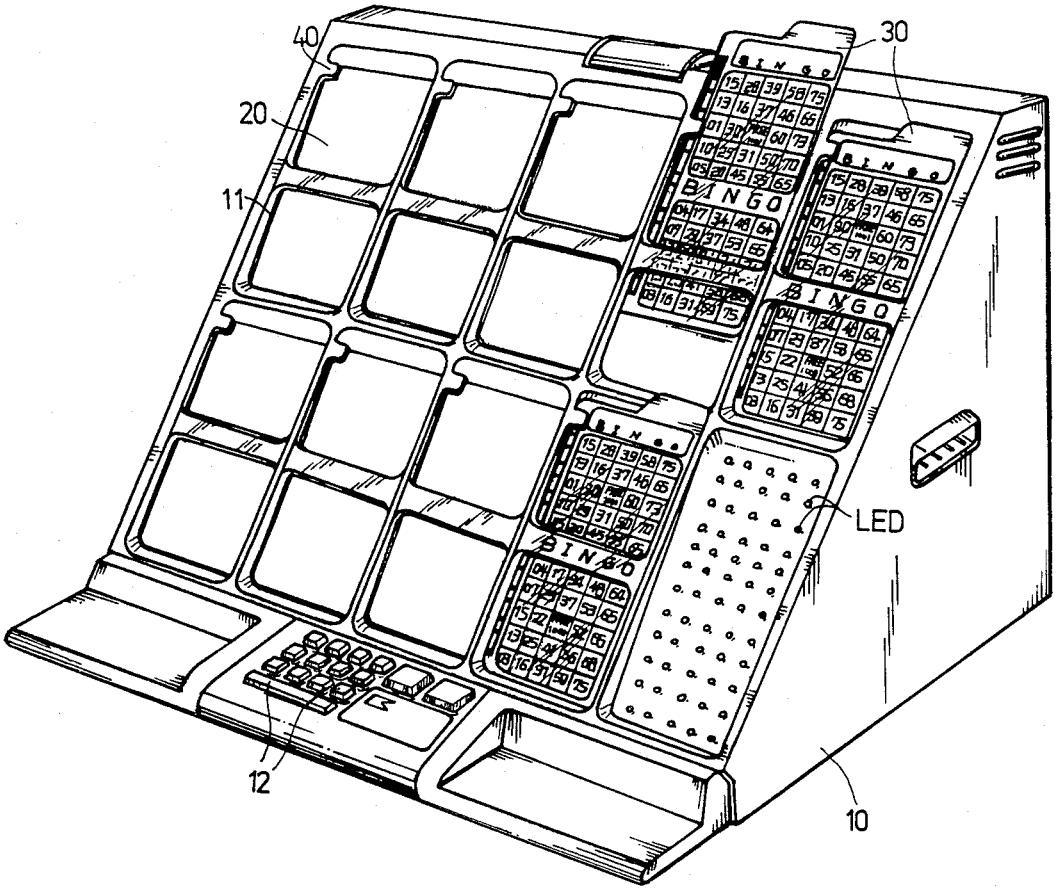
FIG. 1 is a perspective view of the bingo-chain game of the present invention.

The bingo-chain game 10 of the present invention can be interconnected as shown in FIG. 1, which is a perspective view of ten interconnected bingo-chain games. Every bingo-chain game 10 is composed of a display 20, constituted by upper and lower 5×5 LED dot matrixes, and a pair of slot 11. This pair of slots 11 constitute the card keeping means to guide the bingo card 30, to be inserted therein, thereby keeping the bingo card in front of the display 20. Two sets of numbers are printed on the upper and lower areas of the bingo card 30, which is made of transparent material. Each area has twenty-four numbers, ranging from 1 to 75, formed by a 5×5 matrix with an empty space or word "FREE" on the center of the matrix. The number matrix on the bingo card 30 coincides with the dot matrix of the LED display 20. Therefore, each LED can light the related number on the bingo card 30. Punch code 31 (FIG. 5*a*) or bar code is incorporated in a single side of every bingo card 30.

A photo-sensor 40 of the signal reading means is incorporated in a single side of the slots 11 of the bingo-chain game 10. The signal of bingo card 30 will be automatically read when every bingo card 30 is inserted into the slots 11. The signal will then be stored into the storage controlled CPU 50, preferably a Z-80 A processor. The number matrix represented by the inputted signal will then be compared with the called numbers in the next stage. The called numbers are manually inputted by the player through a keyboard 12. The called numbers will also be stored, and will be erased when the game is over. If the called number, inputted to the bingo-chain game 10, is the same as one of the numbers on the bingo card 30, the LED behind the number on bingo card 30 will be lit.

Figure 7:
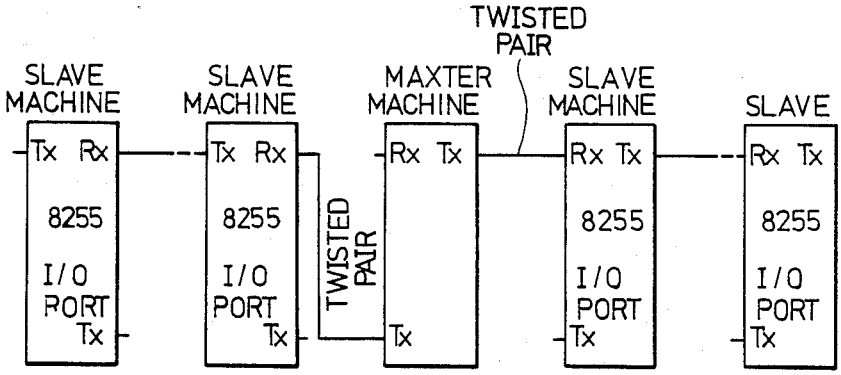
FIG. 7 is a block diagram of the interconnection between a master machine and slave machines of the bingo-chain game of the present invention.

Every bingo-chain game 10 can be assigned as a master machine or slave machine. Interconnected as shown in FIG. 1 and FIG. 7, the signal of each machine can bi-directionally communicate. If one called number is inputted, all LED's in different machines which represent the same called number will be lit simultaneously. During play, only one bingo-chain game 10 needs to be assigned as the master machine, to be connected to the keyboard 12 of the input means. Thereafter, one keyboard can make a plurality of bingo-chain games 10 work concurrently.

Figure 5:
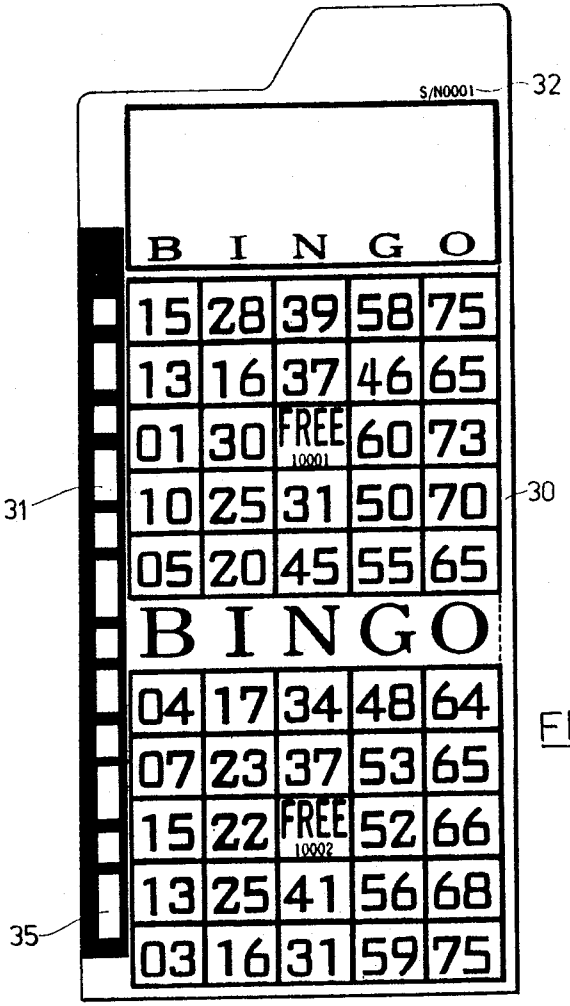
FIG. 5*a* is a front elevational view of the bingo card of the present invention.
FIG. 5*b* is a front elevational view of another embodiment of the bingo card of the present invention.
Figure 5A:
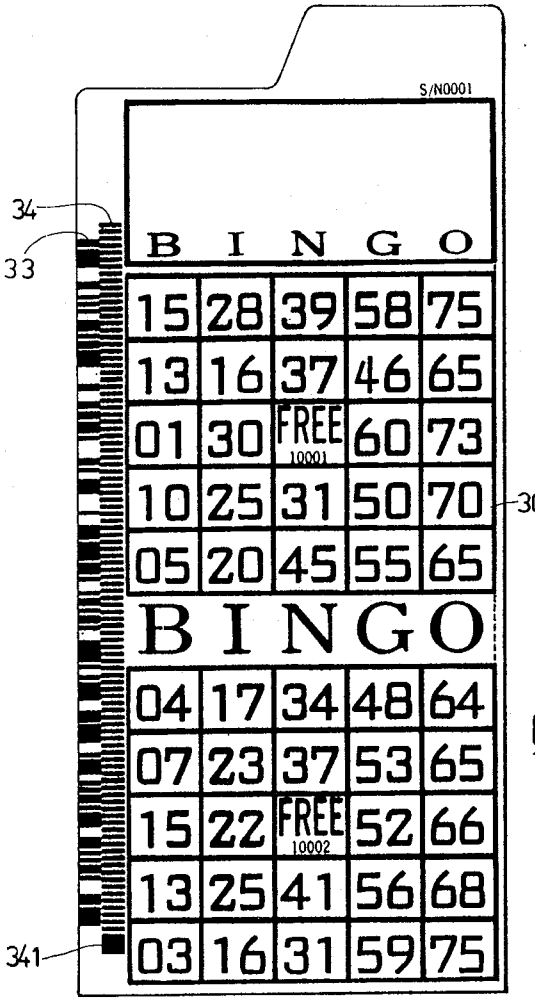
Figure 5A:
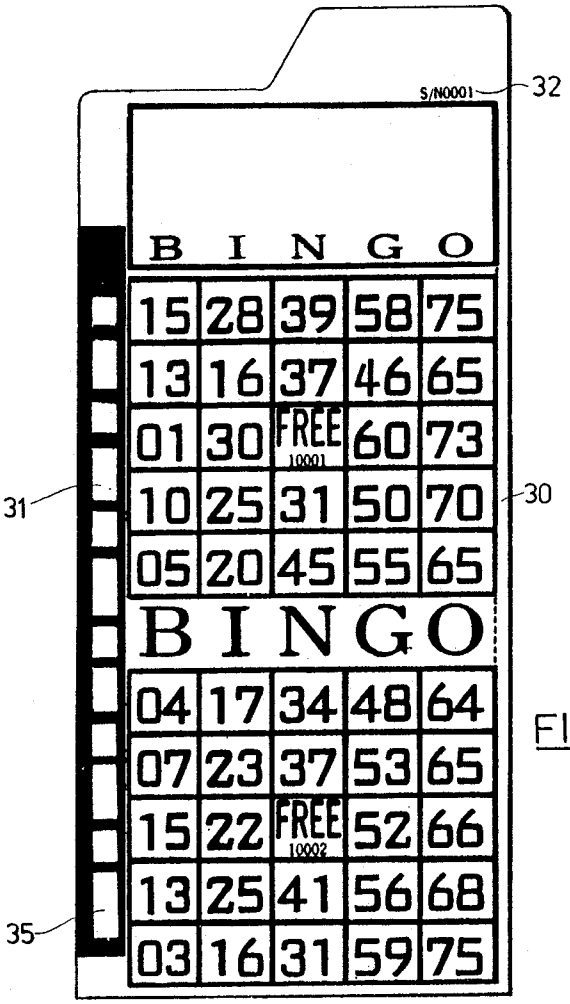

Shown in FIG. 5*a* is a preferred embodiment of bingo card 30. Two 5×5 number matrixes are printed on the upper and lower areas of bingo card 30, which is made of transparent material. Bingo card 30 incorporates a plurality of punch holes 31, separated from each other to represent some signal, along one longitudinal side of the bingo card. The one longitudinal side of the bingo card 30 is made of a non-transparent material. A serial number 32, printed on the upper right corner of bingo card 30, represents the predetermined number matrix stored in the read only memory (thereafter ROM) shown in FIG. 2. The serial number in every bingo card 30 is different from that of another.

Figure 2:
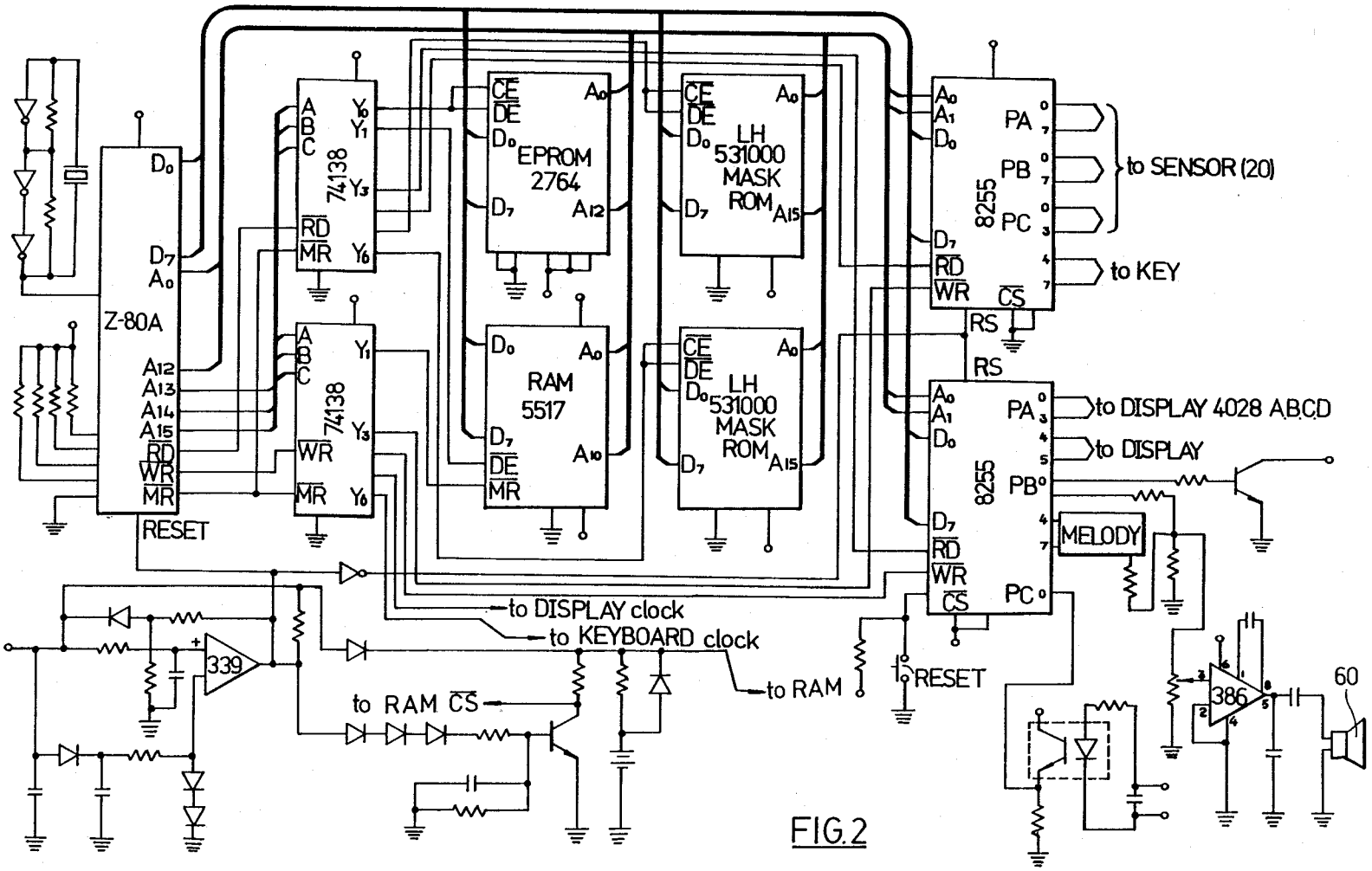
FIG. 2 is a circuit diagram of the CPU based bingo-chain game.

Referring to FIG. 2, the number matrix, represented by the serial number on bingo card 30, can be retrieved from the erasable programmable read only memory (hereafter EPROM) via the selector IC 74LS138. When bingo card 30 is inserted into slots 11 of bingo-chain game 10, the photo-sensor 40 of the signal reading means will first read start code 35, then the bingo code represented by punch hole 31. The bingo code is then translated into a decimal number, which should be the same as the serial number 32 printed on the upper right corner of bingo card 30. The CPU of the bingo-chain game 10 will retrieve the numbers of bingo card 30 from the EPROM and then store the numbers into a random access memory (hereafter RAM) to complete the reading procedure of the bingo card data. Only one set of photo-sensor 40 is needed for this preferred bingo card 30. Therefore, the manufacturing cost is drastically reduced and the asynchronous problems resulting from the traditional dual photo-sensors are eliminated. The reading errors are very scarce during inserting bingo card 30 before the game starts. Furthermore, traditional cards are inclined to erroneous readings, due to incorrect position of printing codes or the unclear printing. Previously, it was necessary for the in-process quality control of the traditional cards to key in 24 numbers to check if the code is coincidental to the numbers printed on each card. But for bingo card 30 of the present invention, the photo-sensor 40 will automatically read the punch hole 31 after the bingo card 30 is inserted into the slot 11. Then the number matrix, represented by the serial number 32 on the upper right corner of the bingo card 30, will automatically be retrieved and compared, thereby making it unnecessary to manually key-in number matrix one by one. Moreover, traditional inspection needs more than 24 key in inputs, compared with the only two key in inputs of the present invention. Therefore, the present invention is more convenient and faster. Furthermore, as the punch operation of the bingo card of the present invention is also fast and accurate, the defective rate of punch operation approaches zero.

Figure 5B:
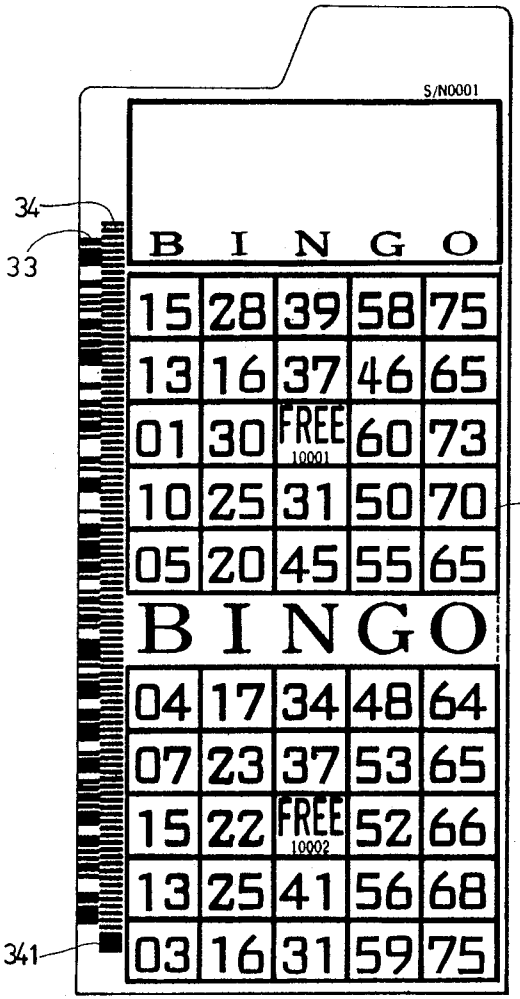
Figure 6A:
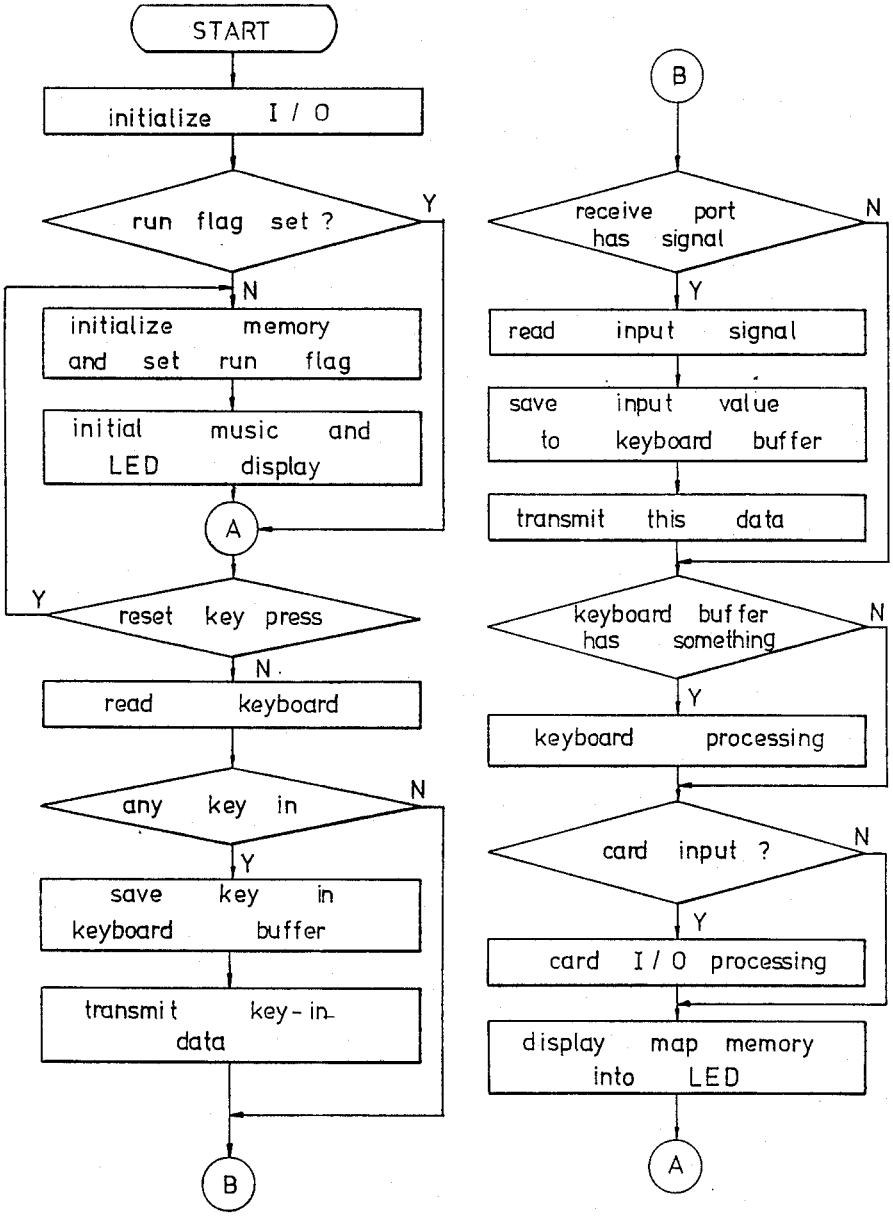
FIGS. 6*a*–6*j* are flow charts of the software program of the present invention.
Figure 6B:
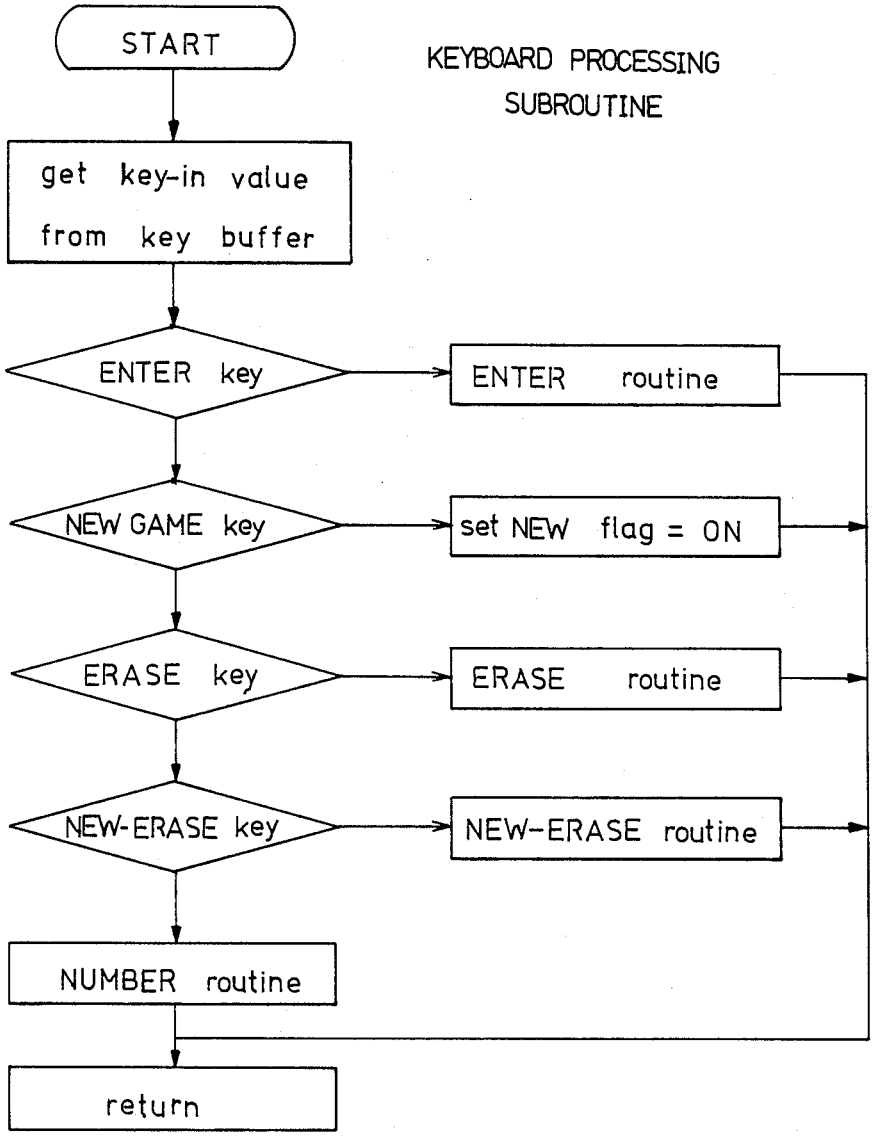
Figure 6C:
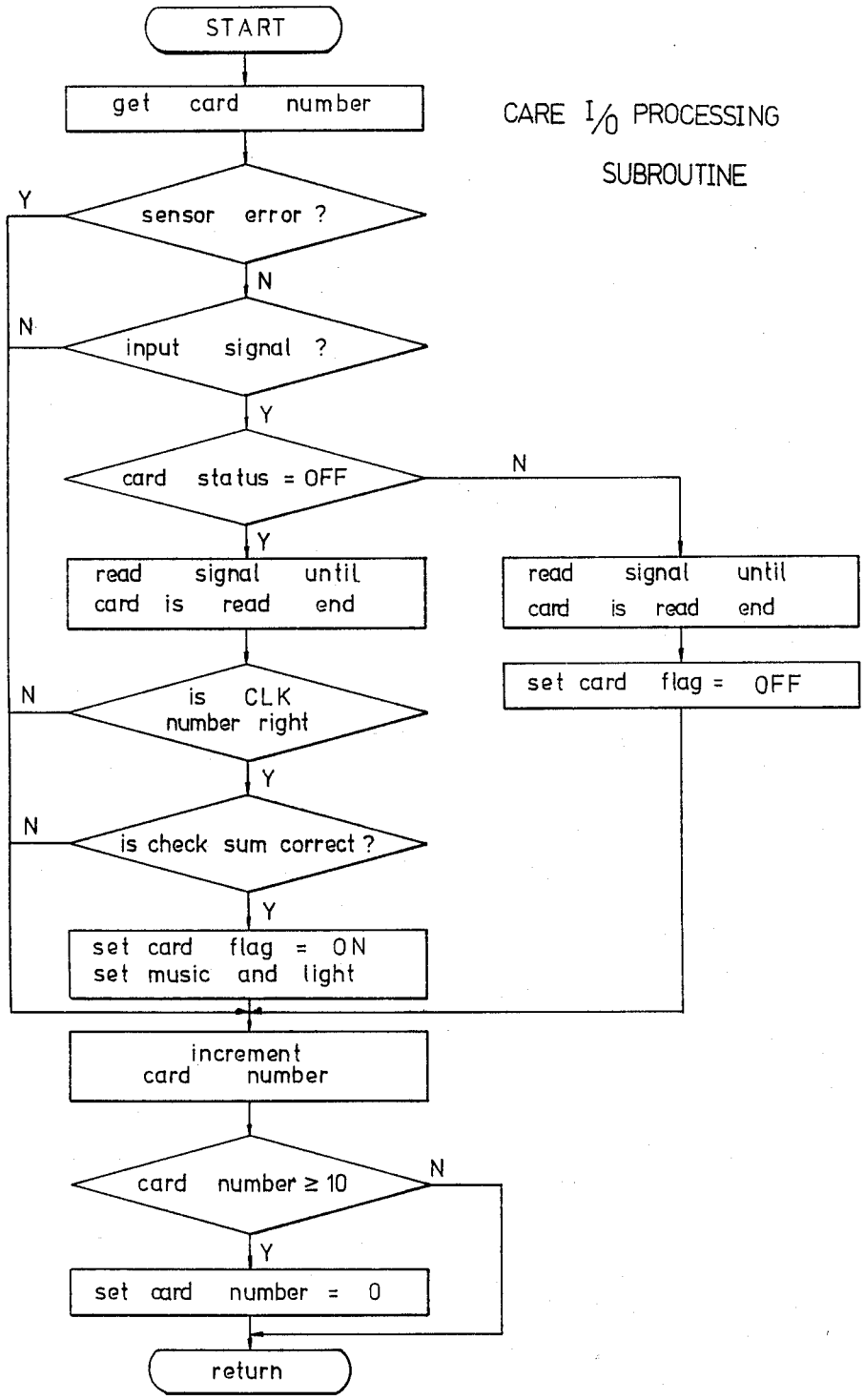
Figure 6D:
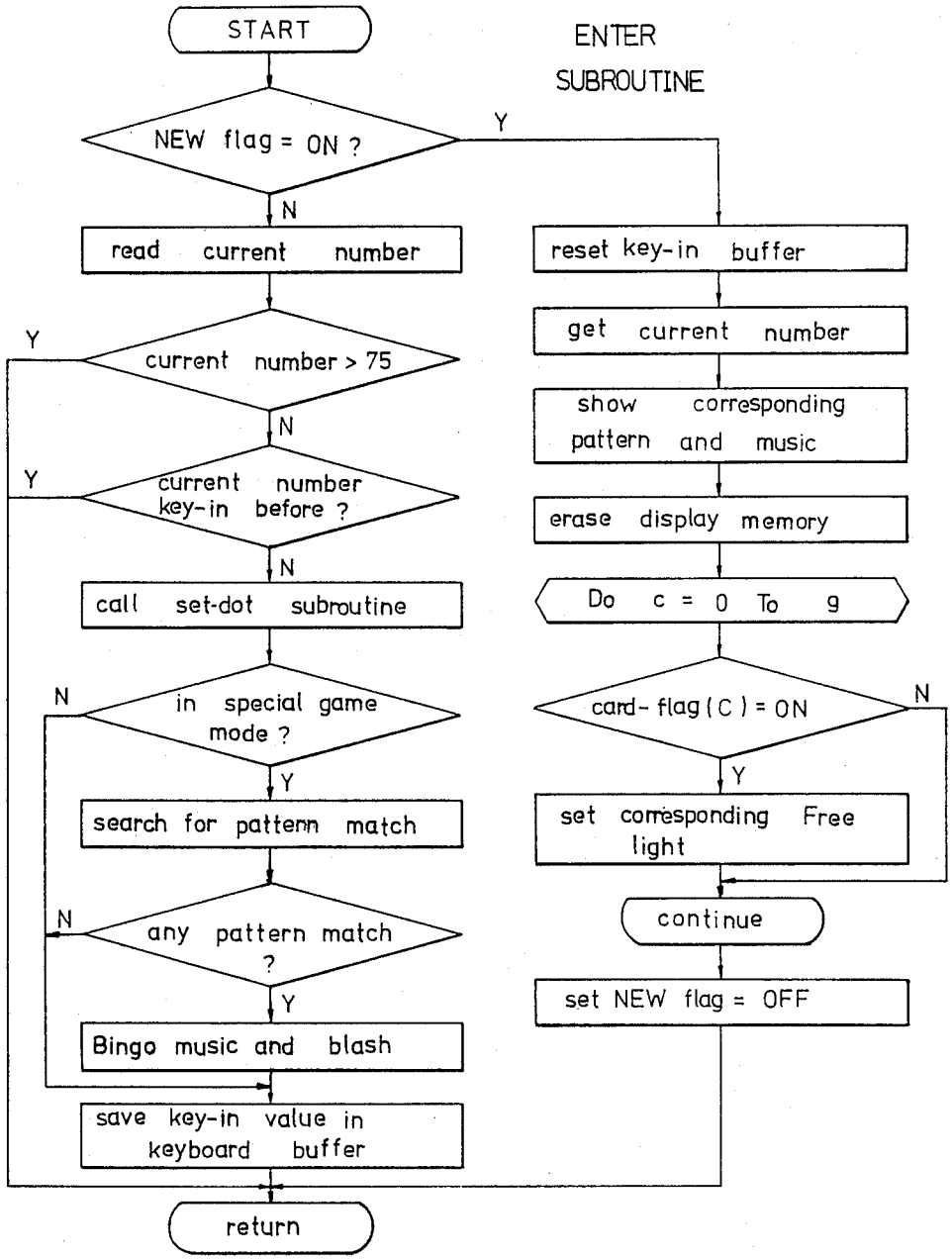
Figure 6E:
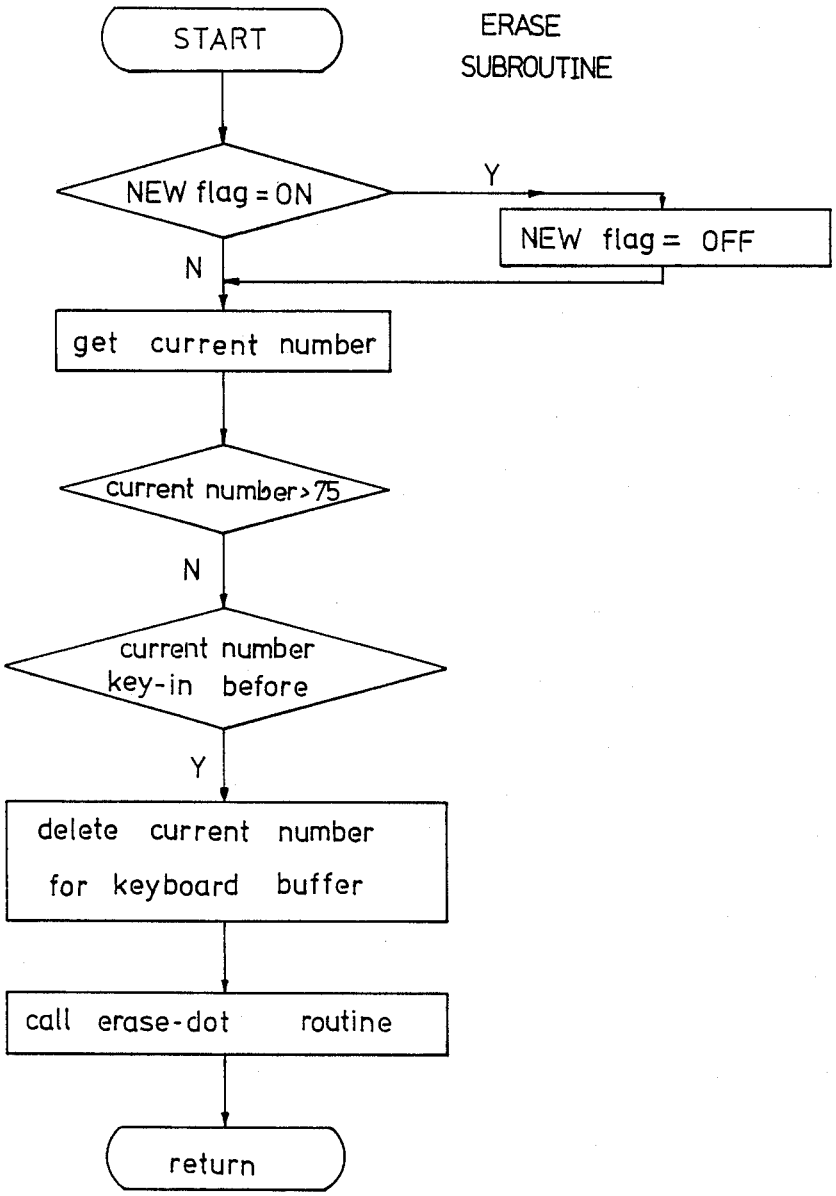
Figure 6F:
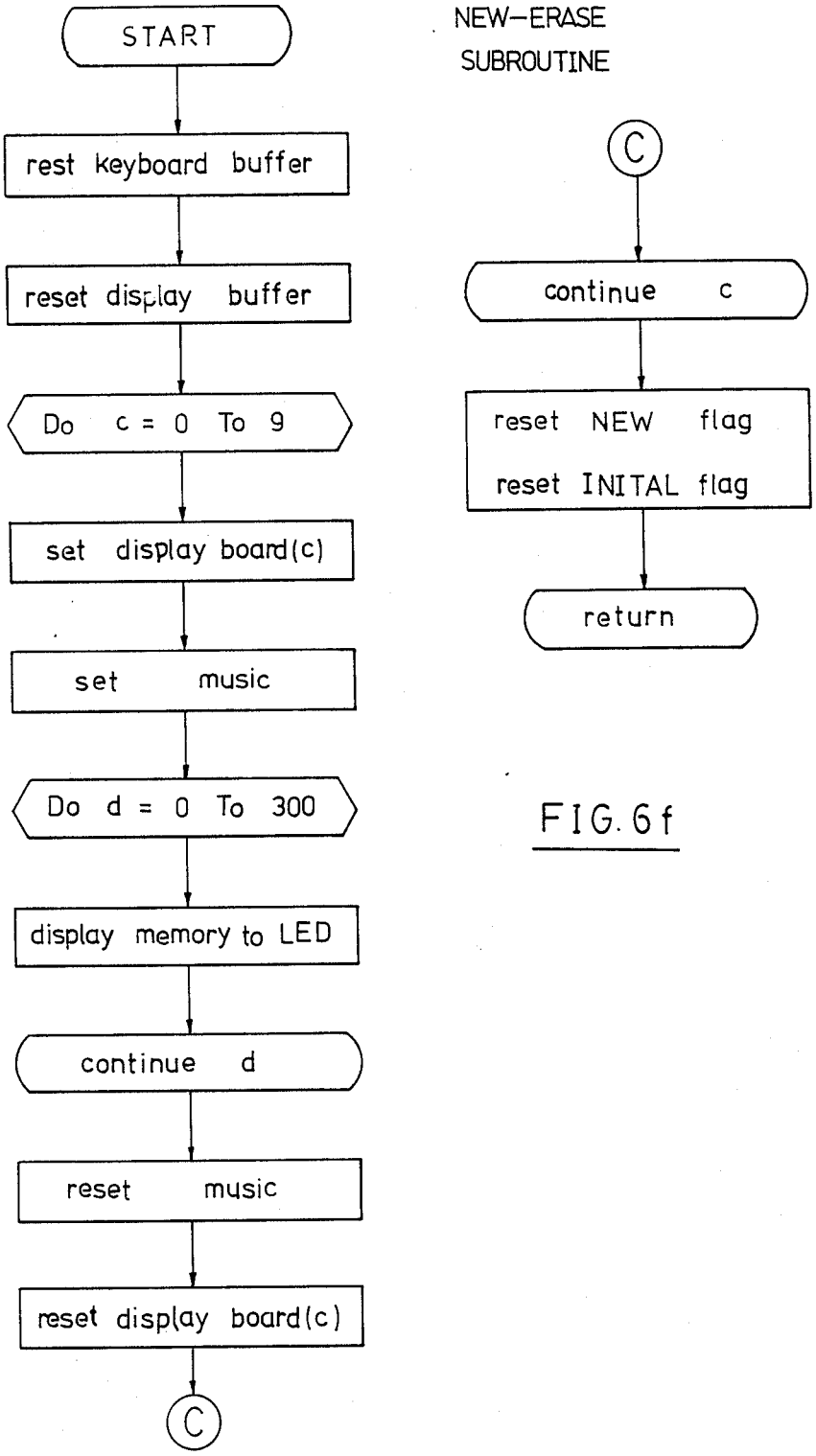
Figure 6G:
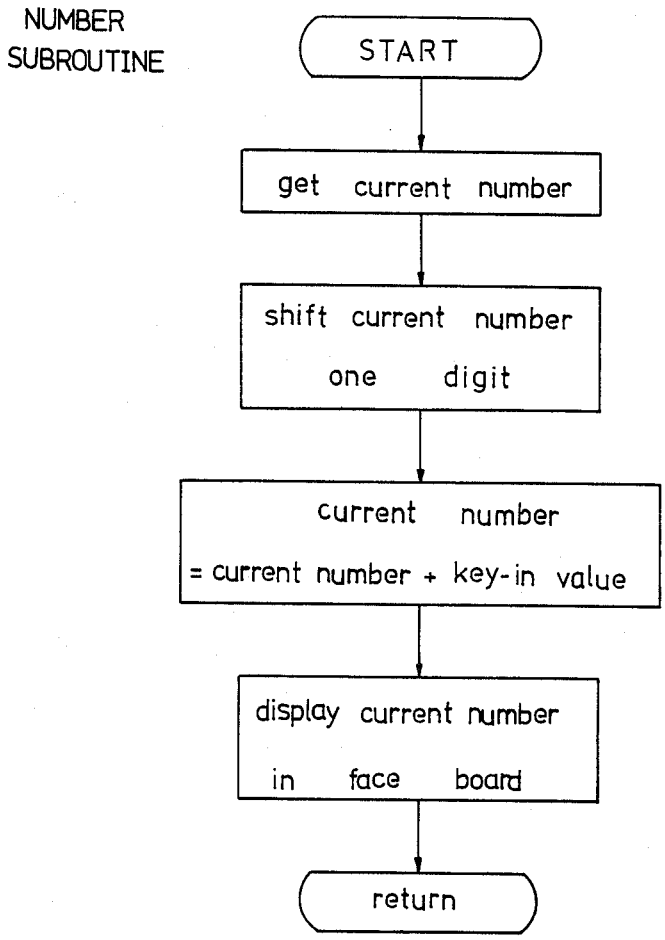
Figure 6H:
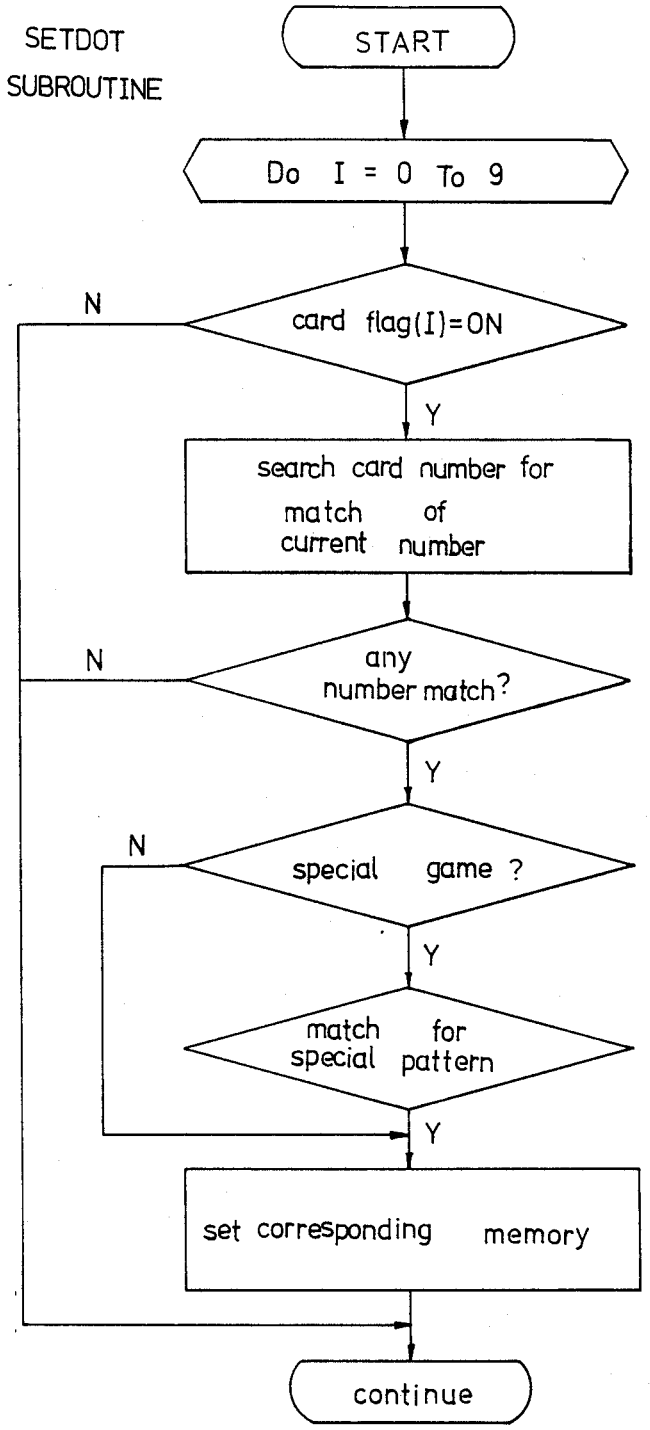
Figure 6I:
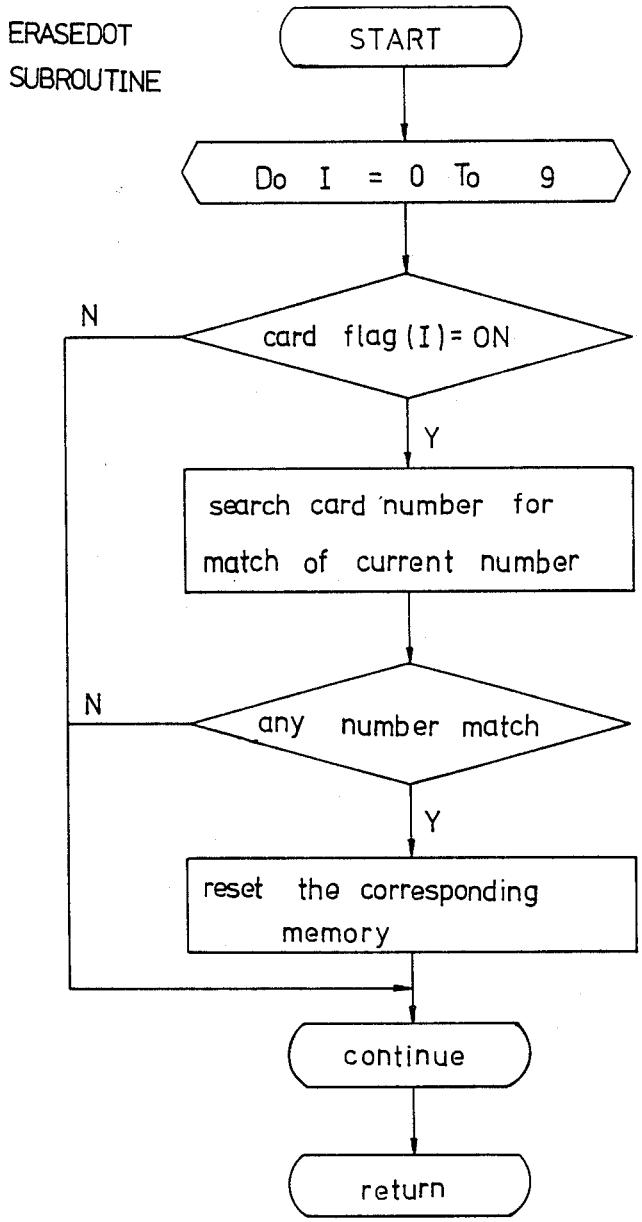
Figure 6J:
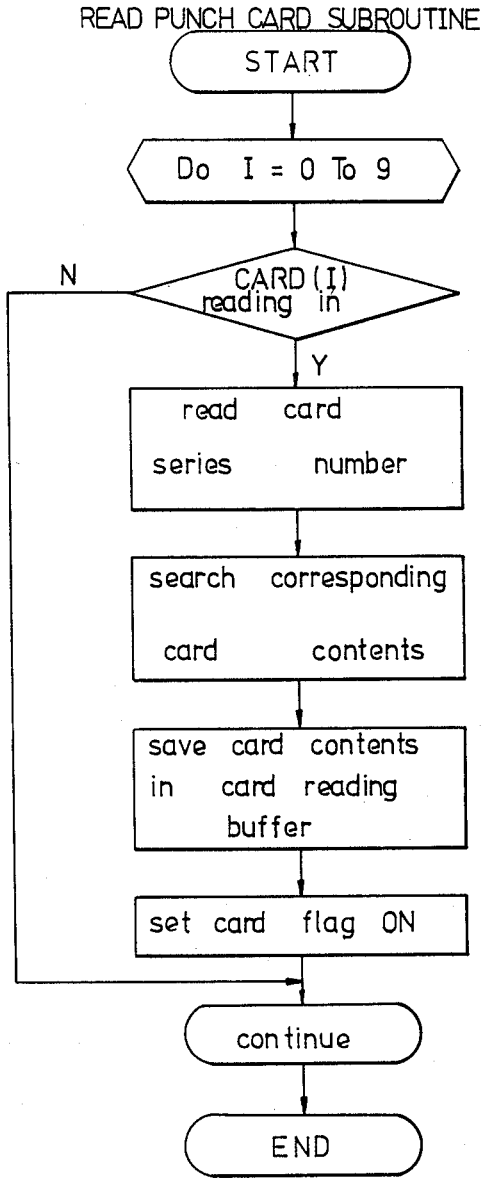

Shown in FIG. 5*b* is another embodiment of a bingo card 30A. The circuit design of the microprocessor/storage means related to bingo card 30A is the same as that shown in FIG. 2. Two 5×5 number matrixes are also printed on the upper and lower areas; respectively, of the bingo card 30A. Bingo card 30A incorporates a bar-type data code 33 and another parallel clock code 34 along one longitudinal side thereof. Concentrating data code 33 and clock code 34 on a single side facilitates the photo sensing operation, so as to eliminate the defect of asynchronous photo sensing due to crooked insertion of a bingo card having two codes incorporated into two different sides of the card. Furthermore, the present invention provides a double check sum for the bingo card 30A, so as to assure error-free data reading of the CPU 50.

The bingo card 30A is designed with a clock code having 204 signals. The wider bar code 341 on the bottom of the clock code 34 is the start code, which can signal the beginning of the reading operation. The number signal of the data code 33 and the clock code 34 can check each other with a function value. A preferred embodiment of the function equation is:

$$F(X)=2+N\cdot 2$$

where F(X) is a clock function, X is the decimal number of the data code 33, N is the number of "0" when the decimal X is translated into binary. The sum of the clock function is treated as one additional code and is placed at the end of the data code 33. The function equation is prestored into the microprocessor/storage means. The clock code 34 and data code 33 are read respectively by two sets of photo-sensors 40, when bingo card 30A is inserted. Clock code 34 and data code 33 are then sent to microprocessor/storage means 50 for checking. The LED relating to the central space (or the word "FREE") of the bingo card 30A will be lit, if the check sum of the 204 signal of the clock code 34 and the function equation match. This is to prove that there is correct reading of the data in the bingo card 30A.

As shown in FIG. 2, the control center of the electronic circuit of the bingo-chain game 10 is the CPU 50, i.e. Z-80 A. CPU 50 controls the other components in the electronic circuit and can also store the called numbers and all numbers of bingo card 30 or 30A read by photo-sensors 40. Software programs, represented by the flow charts from FIG. 6*a* to FIG. 6*j*, are stored into the EPROM or the MASK ROM. Part of the software programs can also be stored into the RAM. CPU 50 can select the keyboard 12 scan, the display 20 scan or the data reading of punch code/bar code in bingo card 30/30A, via the selector 74LS138. Keyboard 20, photo-sensor 40, display 20, sound generator 60 and other peripheral equipment are connected to the microprocessor/storage means via two input-output (hereafter I/O) integrated circuits, hereafter (IC) 8255. Traditional interconnection among various microprocessor/storage means of the present invention can directly communicate via I/O IC 8255, via software. Therefore, the manufacturing cost is drastically reduced. The present invention can further incorporate a rechargeable battery to maintain the related data for three months if power is interrupted.

Figure 3:
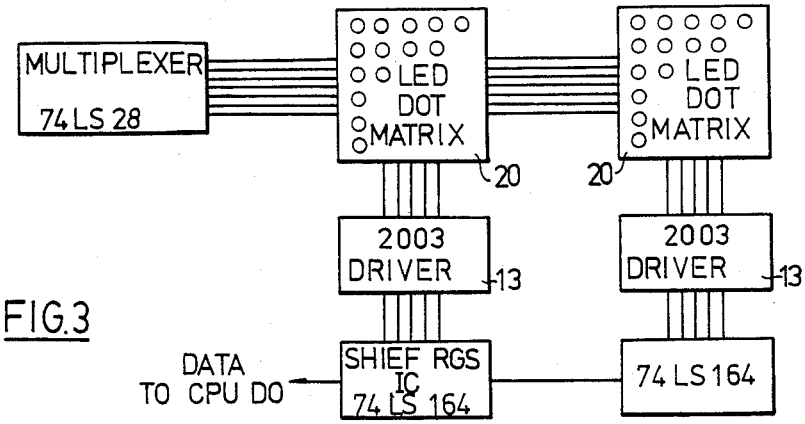
FIG. 3 is a block diagram of the display of the present invention.
Figure 8:
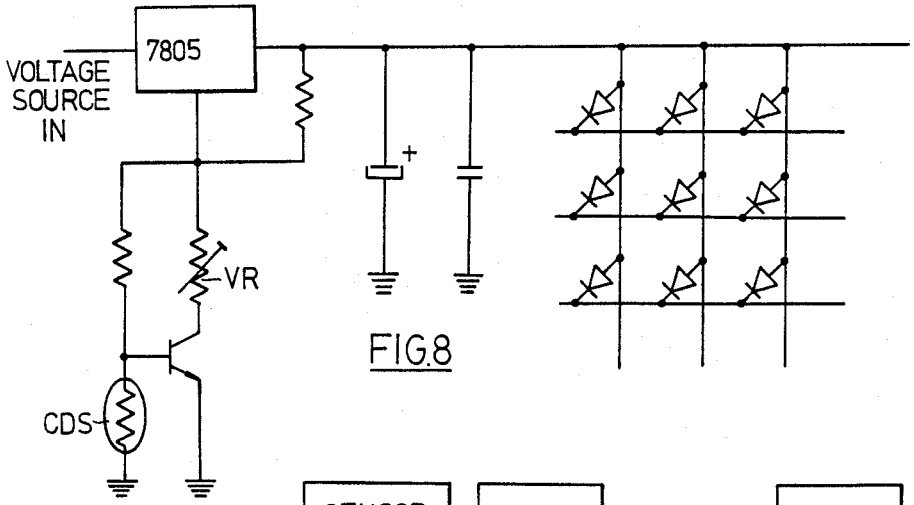
FIG. 8 is a circuit diagram of the display brightness adjustment means of the bingo-chain game of the present invention.

Referring to FIG. 3 of FIG. 8, the display 20 is controlled by the software program represented in the flow charts of FIGS. 6*a*–6*j*. To complete the displaying procedures, the display is scanned by a multiplexor IC, amplified and driven by a driver IC ULN2003 and transmitted via a shift register. If the background is not too bright, the LED of the display 20 can light up the numbers of the bingo card very clearly. But if the background is too bright, the numbers of the bingo card would not be lit up very clearly. To avoid this defect, a perfect LED brightness adjustment circuit including a photo sensitive resistor CDS is incorporated into the present invention. When the background is too bright, the LED input current is increased to raise the brightness of the LED. A variable resistor VR can further be added to the circuit to adjust the LED brightness to the best level.

Figure 4:
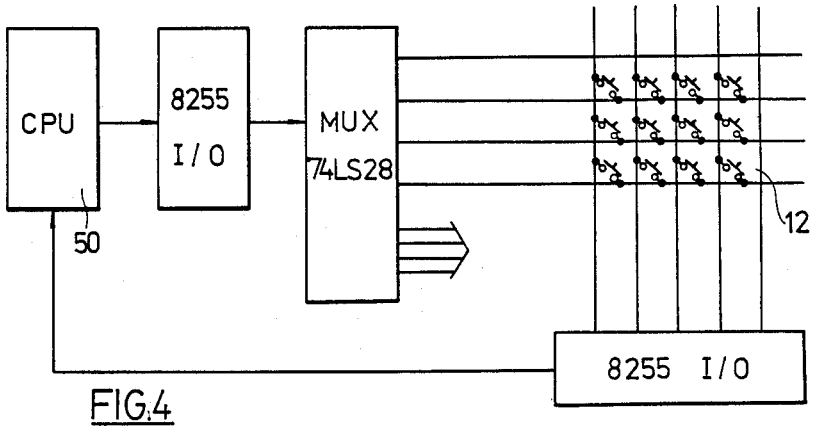
FIG. 4 is a block diagram of the keyboard input means of the present invention.
Figure 13:
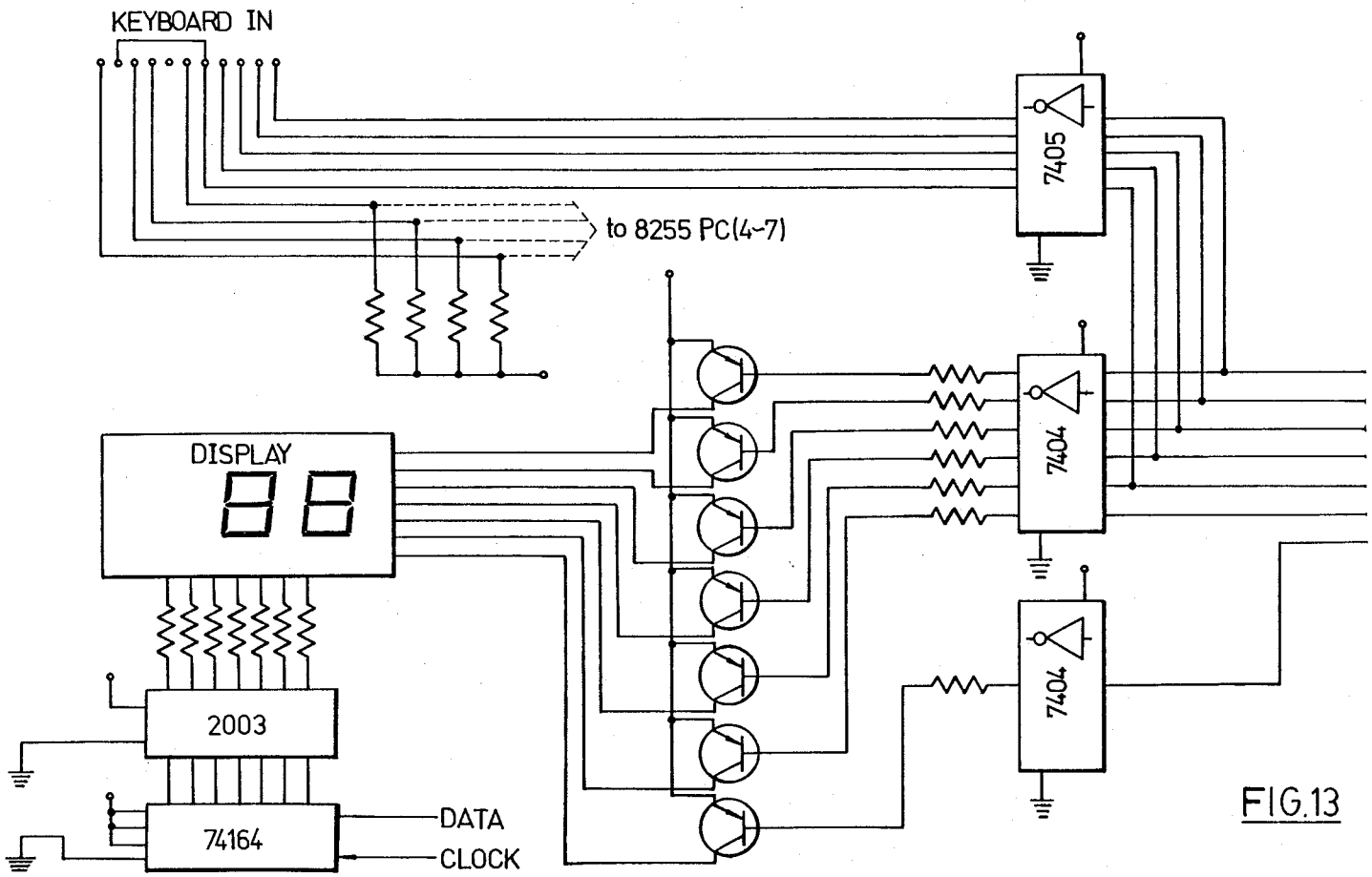
FIG. 13 is a circuit diagram of the keyboard of the present invention.

Referring to FIG. 4 and FIG. 13, the keyboard input means, connected to bingo-chain game 10, is constituted by a MYLAR film. The keyboard input means is interconnected to the CPU 50 via an I/O IC 8255. The keyboard 12 of the input keyboard means is composed of number keys and function keys—such as erase key, bingo key, new game key . . . etc. Such functions as selecting bingo game topic, inputting the called numbers to the microprocessor/storage means, erasing the called numbers from the microprocessor/storage means or starting the game can be done through the input of the number keys and function keys.

Figure 9B:
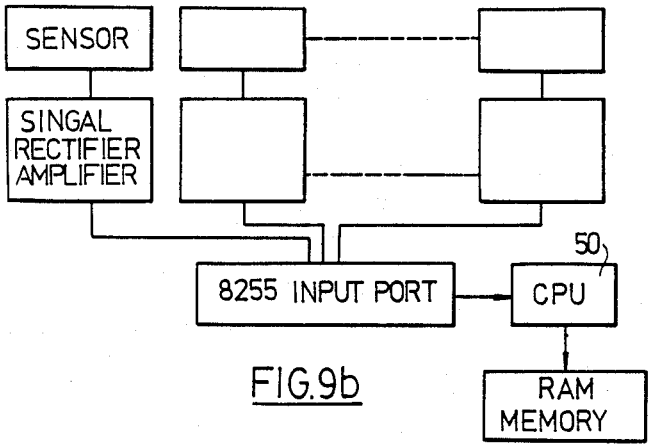
FIG. 9*b* is a block diagram of the signal reading means of the bingo-chain game of the present invention.
Figure 9A:
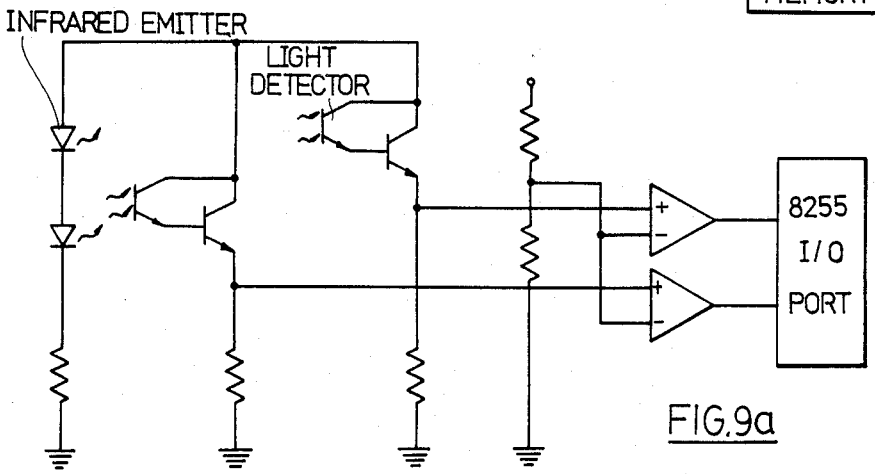
FIG. 9*a* is a circuit diagram of the signal reading means of the bingo-chain game of the present invention.
Figure 10:
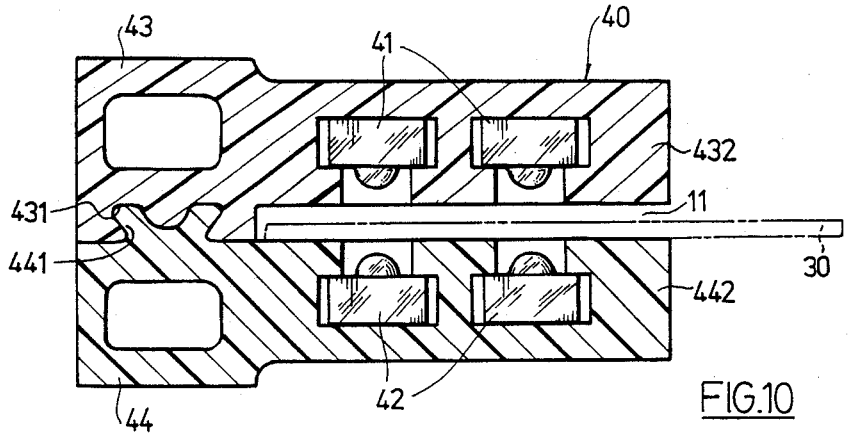
FIG. 10 is a cross-sectional view of the photo-sensor of the signal reading means of the present invention.
Figure 11:
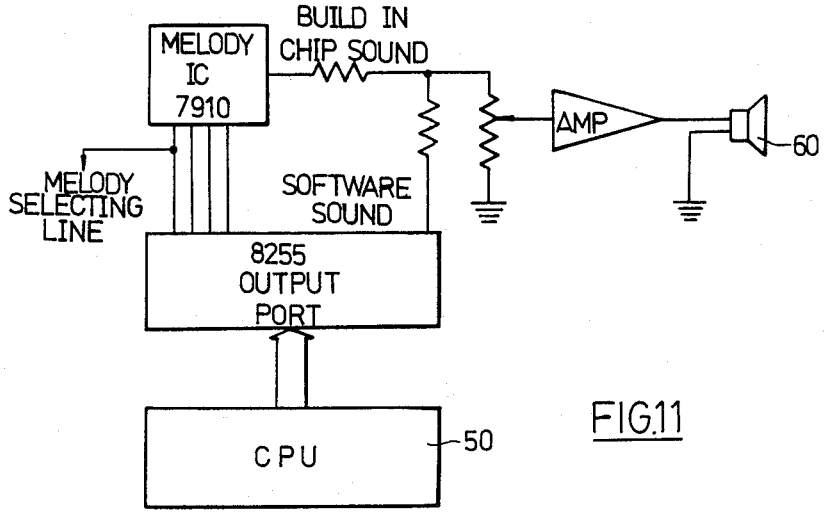
FIG. 11 is a circuit diagram of the sound effect means of the bingo-chain game of the present invention.
Figure 12:
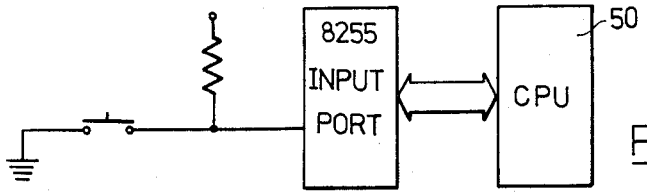
FIG. 12 is a circuit diagram showing the interconnection between the master machine and slave machines.

Referring to FIGS. 9*a*, 9*b* and 10, the photo-sensor 40 of the signal reading means is shown to be comprised of an infrared LED 41 and a photo-coupled receiver 42, which are respectively set in an upper frame 43 and a lower frame 44, made by tooling. The male V-type jut 441 of the lower frame 44 is intimately fitted into the female V-type rail 431 of the upper frame 43. Therefore, the gap between the right arm 432 and the upper frame 43 and the right arm 442 of the lower frame 44 can be kept very even and stable. The infrared LED 41 and the photo-coupled receiver 42 are stuck into the upper right arm 432 and lower right arm 442, respectively. Therefore, bingo card 30 can pass through the gap between upper right arm 432 and lower right arm 442, and at the same time can precisely coincide with infrared LED 41 and photo-coupled receiver 42. A person skilled in the infrared LED 41 and photo-coupled receiver 42 art can easily appreciate that the construction of the present invention is very excellent, so as to make the bingo card insertion operation fast and correct.

To increase the sensitivity of the photo sensor 40, a DARLINTON's power amplifying transistor circuit has been included into the photo-coupled receiver 42, as shown in FIG. 9. When the bingo card 30/30A passes through the photo sensor 40 in the slot 11 of the bingo-chain game 10, the signal in bingo card 30/30A is easily to read.

To add fun to the game, a music generator means composed of a melody IC and an audio generating software program is included in the circuit. The melody IC is connected to the I/O IC. The sound volume of the music generator means can be adjusted through a variable resistor VR.

In addition to the above description, the present invention also includes interconnection means which can send signal bi-directionally through an IC I/O OTPR. The interconnection means can connect a master machine to a plurality of slave machines, affording the latter with the same game functions of the said master machine. There is no limit for the number of the slave machines. It is not necessary for any interface circuit between the interconnnection means and the CPU 50. Therefore, unnecessary means can be reduced so as to lower the manufacturing and maintenance cost.

When the present invention is in game operation, the first step is to turn on the power supply. Thereafter all the LEDs in the display 20 will light to let the player inspect the status of every LED. Then the display will show "BINGO UP GOOD LUCK" characters. The kind of characters are designed by software program and stored into the bingo-chain game 10. Then player can insert bingo cards 30/30A into every slot 11. If the number matrix, represented by the clock code 34 and data code 33 of the bingo card 30/30A, is correctly read by photo-sensor 40, the LED behind the bingo card 30/30A will be lit. If a reading error occurs, no LED will light at all. After all the bingo cards 30/30A are correctly read, the player can key-in the called numbers through the keyboard 12 and press the enter key. Then, the LED behind the same number of the called number on the bingo cards 30/30A will be lit.

The game will continue until one player completes the traditional bingo pattern, which may be all the numbers on the bingo card or all the numbers without the four corners. Then the winning player presses the bingo key, the bingo-chain game 10 will play congratulation music and make the LEDs blink.

The present invention can also store a number of character patterns into the EPROM or MASK ROM by software program. To play these new character patterns, the players can read all bingo cards 30/30A and then press the "NEW GAME" key, a specified number key, and the "ENTER" key. Thereafter the display 20 will show a specified character pattern. IF the special numbers within the specified character pattern are the same as the called number inputted from keyboard 12, the LEDs at the back of the called numbers will light. Otherwise, the LEDs will not light. The player who first completes the specified character pattern will win the game. This special design prevents cheating during the game.

When the game is over, all the key-in called numbers can be erased after the "NEW GAME" key and the "ERASE" key are pressed. If the called number is incorrect during the game, the incorrect called number can be erased by pressing the same called number again and then pressing the "ERASE" key. The bingo-chain game 10 will then be ready for the next step of the game.

The various preferred embodiments of the present invention described in the above paragraphs are just for illustrating the technologies of the present invention only and are not meant to limit the present invention, as equivalents of the present invention would be obvious to one skilled in the art, in view of the above discussion. The enclosed program listing is a further example implementation of the present invention.

I claim:

1. A computerized bingo-chain game device comprising:

a processor/storage means interconnected with a display for storing and retrieving data from bingo cards;

a keyboard means for inputting data into the processor/storage means, the keyboard means constituted by a MYLAR film;

card keeping means having slots positioned in front of the display;

a signal reading means positioned in a side of the slots of the card keeping means electrically connected to the processor/storage means;

wherein the processor/storage means includes:

a read only memory circuit;

a random access memory circuit; and at least one input/output port for providing interconnections to peripheral components;

wherein a plurality of number matrices and matrix serial numbers are stored in the read only memory circuit, each matrix serial number being representative of a signal code located at a single side of a transparent bingo card having a plurality of numbers thereon, the signal reading means automatically reading the code on the bingo card when the same is passed therethrough, the bingo card being kept in front of the display by the card keeping means, the signal reading means further sending a signal representative of the matrix serial number to the processor/storage means, the processor/storage means retrieving a number matrix relating to the matrix serial number from the read only memory circuit, the processor/storage means further sending the number matrix to the random access memory circuit for comparing with a called number inputted from the keyboard means, the result of the comparison being shown on the display;

wherein the display includes at least one LED dot matrix connected with the processor/storage means; and wherein the respective LEDs of the LED dot matrix are lit for illuminating the numbers on the bingo card corresponding to called numbers inputted from the keyboard means, thereby assisting a player during a bingo-chain game;

an erasing means connected to the processor/storage means for erasing the called numbers upon completion of the game; and wherein a punch code is incorporated in a side of the bingo card to represent the serial number of the bingo card; and wherein the punch code comprises a number of punch holes with different lengths to represent binary-based 0's or 1's and a longer hole at the beginning of the punch code to represent a start code; thereby providing for the retrieval of the pre-stored number matrix of the bingo card from the processor/storage means.

2. A computerized bingo-chain game device comprising:

a processor/storage means interconnected with a display for storing and retrieving data from bingo cards;

a keyboard means for inputting data into the processor/storage means, the keyboard means constituted by a MYLAR film;

card keeping means having slots positioned in front of the display;

a signal reading means positioned in a side of the slots of the card keeping means electrically connected to the processor/storage means;

wherein the processor/storage means includes;

a read only memory circuit;

a random access memory circuit; and at least one input/output port for providing interconnections to peripheral components;

wherein a plurality of number matrices and matrix serial numbers are stored in the read only memory circuit, each matrix serial number being representative of a signal code located at a single side of a transparent bingo card having a plurality of numbers thereon, the signal reading means automatically reading the code on the bingo card when the same is passed therethrough, the bingo card being kept in front of the display by the card keeping means, the signal reading means further sending a signal representative of the matrix serial number to the processor/storage means, the processor/storage means retrieving a number matrix relating to the matrix serial number from the read only memory circuit, the processor/storage means further sending the number matrix to the randcom access memory circuit for comparing with a called number inputted from the keyboard means, the result of the comparison being shown on the display;

wherein the display includes at least one LED dot matrix connected with the processor/storage means; and wherein the respective LEDs of the LED dot matrix are lit for illuminating the numbers on the bingo card corresponding to called numbers inputted from the keyboard means, thereby assisting a player during a bingo-chain game;

an erasing means connected to the processor/storage means for erasing the called numbers upon completion of the game; and wherein the bingo card comprises parallel data and clock codes at one of its sides; and wherein the data code and clock code, represented by binary-based black and white bar codes, respectively, and a wider bar code at the beginning of the clock code are represented by the following function equation:

$$F(X)=2+N\cdot 2$$

wherein X is the decimal number of the data code, N is the number of "0's" when the decimal number X is translated into binary; and wherein the function values of the data code and clock code are checked and compared by the processor/storage means to determine erroneous readings by the signal reading means.

* * * * *